US007815484B2

(12) United States Patent
Kriman et al.

(10) Patent No.: US 7,815,484 B2
(45) Date of Patent: Oct. 19, 2010

(54) ELECTROSTATIC TOY

(76) Inventors: Boris Kriman, 1785 Withmere Way, Atlanta, GA (US) 30338; Ravil Nasyrov, Batyrshine 19 Kv. 45, Kazan 420033 (RU)

( * ) Notice: Subject to any disclaimer, the term of this patent is extended or adjusted under 35 U.S.C. 154(b) by 272 days.

(21) Appl. No.: 12/070,142

(22) Filed: Feb. 14, 2008

(65) Prior Publication Data

US 2009/0209171 A1 Aug. 20, 2009

(51) Int. Cl.
*A63H 33/00* (2006.01)

(52) U.S. Cl. ..... 446/140; 446/484

(58) Field of Classification Search ..... 446/15, 446/17, 19, 140, 225, 226, 230, 484
See application file for complete search history.

(56) References Cited

U.S. PATENT DOCUMENTS

| | | | | |
|---|---|---|---|---|
| 2,018,585 | A | 1/1935 | Weil | |
| 3,497,994 | A | 3/1970 | Lee | |
| 4,109,413 | A | 8/1978 | Brown | |
| 4,988,319 | A * | 1/1991 | Sheng | 446/19 |
| 5,080,623 | A * | 1/1992 | Stein | 446/15 |
| 2006/0172654 | A1 * | 8/2006 | Asperas | 446/97 |

* cited by examiner

*Primary Examiner*—Nini Legesse
(74) *Attorney, Agent, or Firm*—I. Zborovsky

(57) ABSTRACT

An electrostatic toy has a levitating object; and an electrostatic wand which causes levitation of the object and is provided with an electrostatic generator that charges the wand and is operatable by one hand of a user.

9 Claims, 16 Drawing Sheets

ELECTROSTATIC TOY

BACKGROUND OF THE INVENTION

The present invention relates to electriciostatic toys, in which a playing effect is obtained by controlled levitation of light electrifying objects in an electrostatic field.

Toys are known in which the effective levitation is produced with the use of an electrostatic field, as disclosed for example in U.S. Pat. Nos. 2,018,585; 3,497,994; 4,109,413. These toys include one or several wands and levitating objects which are composed of a polymeric film or an aluminum foil. An electric charge of the wand is obtained by a manual rubbing of the surface of the wand. A contact of the charged wand with a light levitating object leads to a transfer of a part of the electric charge from the wand onto the object, and thereafter an electrostatic repelling of the identically charged wand and the light object takes place, that imitates the effect of levitation.

The disadvantage of the known toys is connected with a manual rubbing of the wand. During the process of playing, the electric charge gradually leaks out both from the wand and from the levitating object, and therefore is necessary to provide periodical charging by means of an additional rubbing of the wand. This recharging leads to an interruption of the process of controlling the levitating object. During rubbing of the wand, a playing person can loose control of the levitating object, which can be dropped or can become attached to an electrically neutral object located in the vicinity. In addition, during the recharging by means of rubbing, the efficiency and speed of charging of the wand depends on how fast the displacement of the rubbing surfaces takes place and how tight they are in contact with one another. A playing person needs special skills for performing fast recharging without loss of control of the levitating object. Obtaining of these skills can be difficult for a playing child.

Another disadvantage of the known electrostatic toys is a relatively low flight height of the levitating object above the wand. The height of the flight of the levitating object depends on the force of electrostatic repellance and weight of the object, and the force of electrostatic repelling compensate the weight of the object. In order to increase the height of the flight it is necessary to increase the charge of the levitating object and to reduce its weight to a minimum. Levitating objects composed of electrically conductive materials are charged the best way when they are brought in contact with the electrically charged wand. Therefore, in U.S. Pat. No. 2,018,585 the figures composed of aluminum foil are used as the levitating object. However, such levitating objects are too heavy and they can not fly very high because of a high specific density of the foil.

The electrostatic toy disclosed in U.S. Pat. No. 4,109,413 contains a light levitating object which is composed of a flat or a three dimensional figure from a polymeric film, while the electric wand is charged by a manual rubbing.

The objects which are composed of a polymeric film are lighter than the object composed of a foil and can fly higher. However, their charging is more difficult by contact with the surface of the electrically charged wand, and this also makes more difficult the increase of a flight height.

SUMMARY OF THE INVENTION

Accordingly, it is an object of the present invention to provide a safe electrostatic toy, in which a process of charging a wand is automated, a flight height is increased, a position of the levitating objects is stabilized, and which also exhibits original aerodynamic effects of action of an electrostatic field onto the charged objects.

In keeping with these objects and with others which will become apparent hereinafter, one feature of the present invention resides, briefly stated, in an electrostatic toy, comprising a levitating object; an electrostatic wand which causes levitation of the object; said wand being provided with an electrostatic generator for charging said wand and is operatable with one hand of a user.

When the electrostatic toy is designed in accordance with the present invention, it eliminates the disadvantages of the prior art and provides the above mentioned advantages for an electrostatic toy and a playing person.

The electrostatic generator can be composed of a converter of direct current to alternating current, a high voltage transformer and a rectifier with a voltage multiplying circuit, connected in series with one another.

The generator of electrostatic voltage can be formed as a direct current breaker in a circuit of a primary winding of a high voltage increasing transformer, while its secondary winding can be connected with an accumulator of charge.

The electrostatic generator can be also composed of a piezo-electric converter of a mechanical energy to an electrical energy and can include a piezoelectric crystal with electric terminals and a lever mechanism for compressing the crystal. One of the terminals of the piezocrystal can be grounded, while the other terminal can be connected with the charge accumulator.

Also, the electrostatic generator can be formed as a Van de Graaf generator and can include a hollow charge accumulator composed of an electrically conductive material, an electric drive, two pulleys connected with one another by a belt transmission, with one pulley composed of a dielectric material and arranged on the shaft of the drive, and the other pulley composed of metal, and two brushes for taking the electrostatic charge and formed as needles or combs which face perpendicularly toward an exterior surface of the belt transmission, with one brush connected through a handle of the generator with a hand of a playing person and arranged near the dielectric pulley, and the other brush connected with the electric charge accumulator and arranged near the metallic pulley.

In order to provide an additional possibility of obtaining levitating objects in form of charged soap bubbles, the charge accumulator can be provided with a pipe for blowing an electrically charged soap bubble.

A great variety of electrostatic generators are known. Practically in all known generators, as disclosed for example in Electrostatic Generators http://www.coe.ufri.br/~acmq/electrostatic.html. Practically in all known solutions the electric charge accumulators are composed of metal. When the charge accumulator is touched by a hand, an electrical discharge takes place. Electrical charge flows from the accumulator, and as a result an electric shock occurs. This shock as a rule is not dangerous, since the charge accumulated in small electrostatic generators is insignificant and can cause only unpleasant feelings. In order to avoid a possibility of such electric discharge during an accidental touching of a hand or a body with the charge end of the wand, the charge accumulator is composed of a .material with a high specific resistance or low specific electrical conductivity. Such a material can be an electrically conductive plastic, paper or cardboard. Because of the high specific resistance of the material, during touching of the charge accumulator with a hand the charge flows significantly slower than from a metallic accumulator. This excludes a possibility of electrical shock and unpleasant feelings connected with it.

The levitating objects can have the shape of an airplane, a spaceship, a rocket, a human being, an animal, a bird, a butterfly, a dragonfly, an insect, and also can have a shape of a ring, a sphere, a semi-sphere, a torus, an ellipsoid or parabolloid which are glued from thin strips of a metallized film or produced by cut-through of flat sheets of the metallized film or thin cigarette (tissue) paper.

For obtaining a rotation of the levitating object it can be formed as an elongated unilateral triangle with a base provided with a throughout and opposite laterally bent petals. In another variant, the levitating object can be composed of a strip of a preliminarily twisted metallized film.

For obtaining a vertical position in space, preventing sharp movements and improving controllability, some levitating objects can be additionally provided with vertical position stabilizers. A vertical position stabilizer of the levitating object can be formed as a bundle or a fan composed of synthetic or natural fibers, attached to an upper part of the levitating object and/or a corresponding weight in its lower part.

The wand can be recharged with one hand, which eliminates possible interruptions in the process of playing for recharging the wand and simplifies playing of the wand with the objects of levitation. When the levitating objects are composed of a dielectric material with a metallized coating, it allows to improve the electrifying, to increase electrical force of repelling from the wand, and simultaneously to reduce weight of the levitating objects, which leads to a significant increase of hovering of the levitating objects above the wand.

When the levitating objects are provided with electrifiable fibers, a spatial stabilization of the levitating figures can be obtained. The use of the electrostatic generator with a charge accumulator composed of a material with a low specific electrical conductivity protects a playing person from possible electric shock when he or she touches the accumulator with his or her hand.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
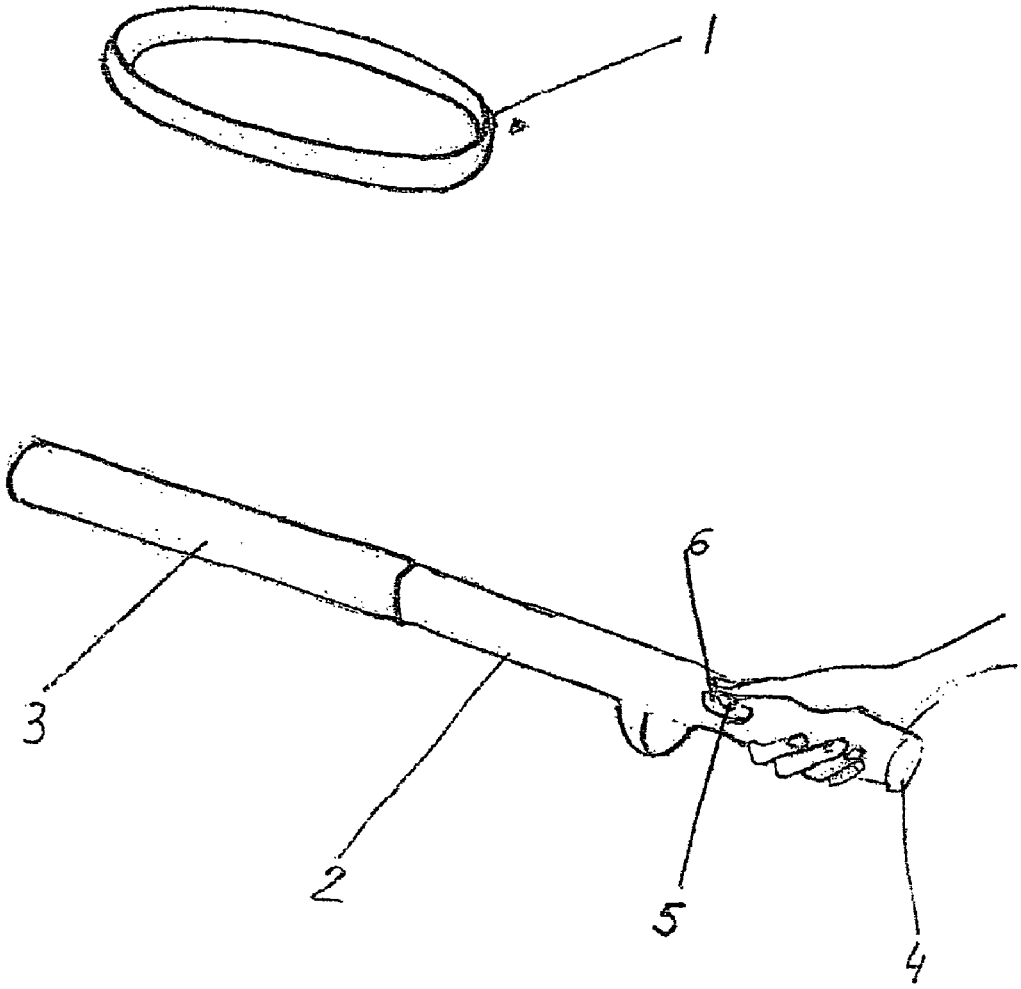
FIG. 1 is a view schematically showing an electrostatic toy in accordance with the present invention.

An electrostatic toy in accordance with the present invention is shown in FIG. 1. As can be seen from this Figure, it includes a levitating object which is identified with reference numeral 1 and formed, for example, as a ring. The electrostatic toy further has an electrically chargeable wand which is identified with reference numeral 2.

The electrostatically chargeable wand 2 has a cylindrical casing, and an electrostatic generator provided with a power source is arranged inside the cylindrical casing. The output of the generator is connected with an accumulator of electrical charges 3. The accumulator of electrical charges 3 can be formed as a cylinder composed of an electrically conductive material with a high specific resistance and arranged at the end of the wand which is opposite to a handle 4. The handle 4 can be provided with a button 5 with an electrically conductive gasket under it. A battery 13 is located in the handle.

Figure 2:
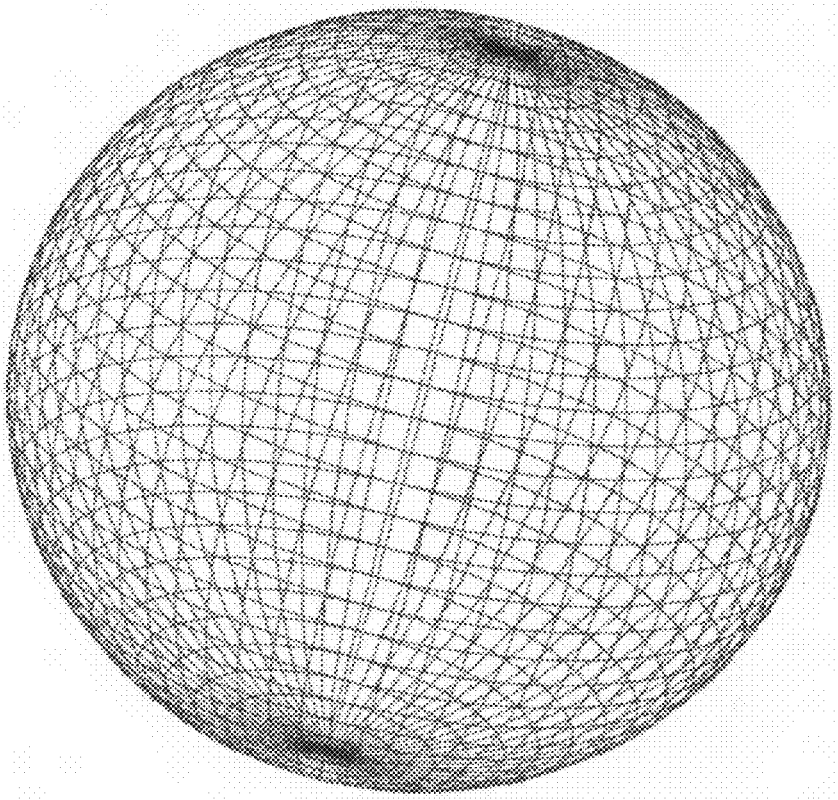
FIGS. 2-10 are views showing examples of various levitating objects of the electrostatic toy in accordance with the present invention.
Figure 3:
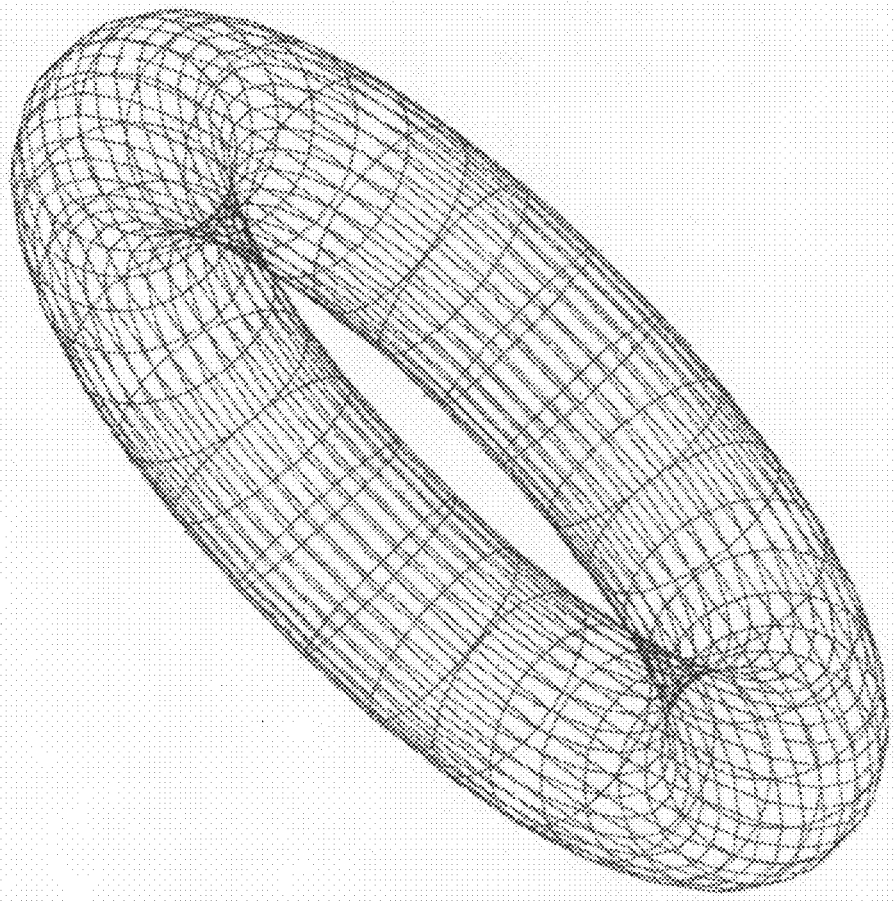

FIG. 1 shows the levitating object formed as a ring. FIG. 2 shows the levitating object formed as a sphere composed of metallized polymeric bands. FIG. 3 shows a levitating object formed as a torus.

Figure 4:
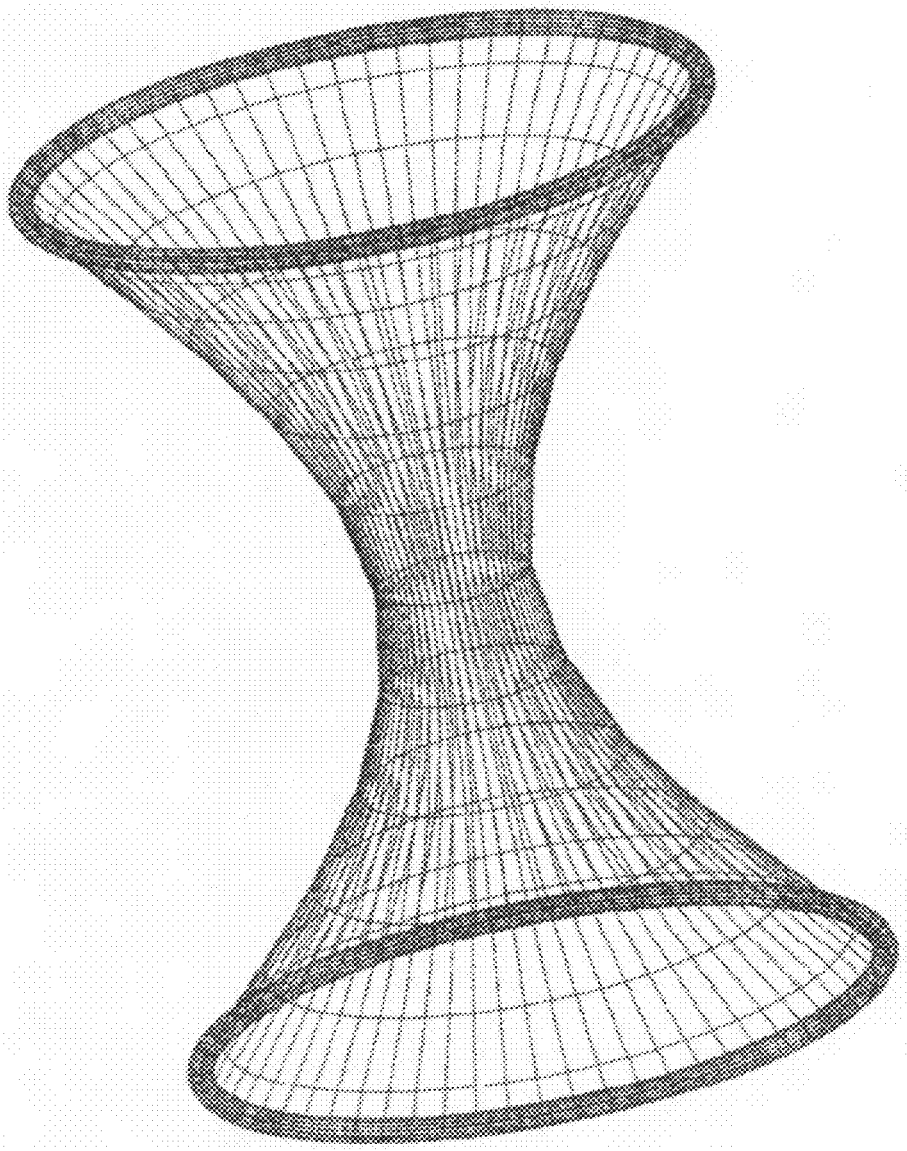
Figure 5:
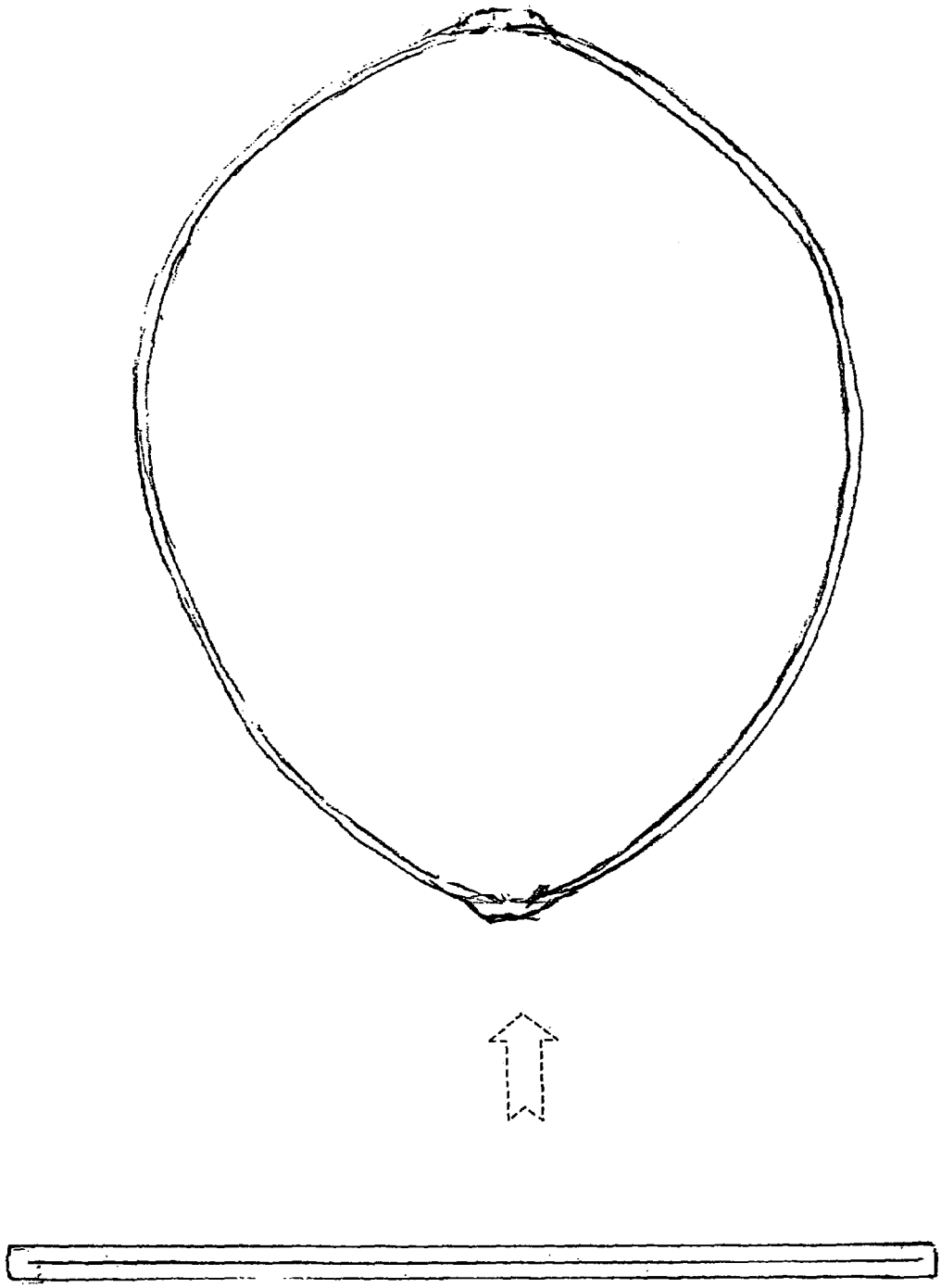
Figure 6:
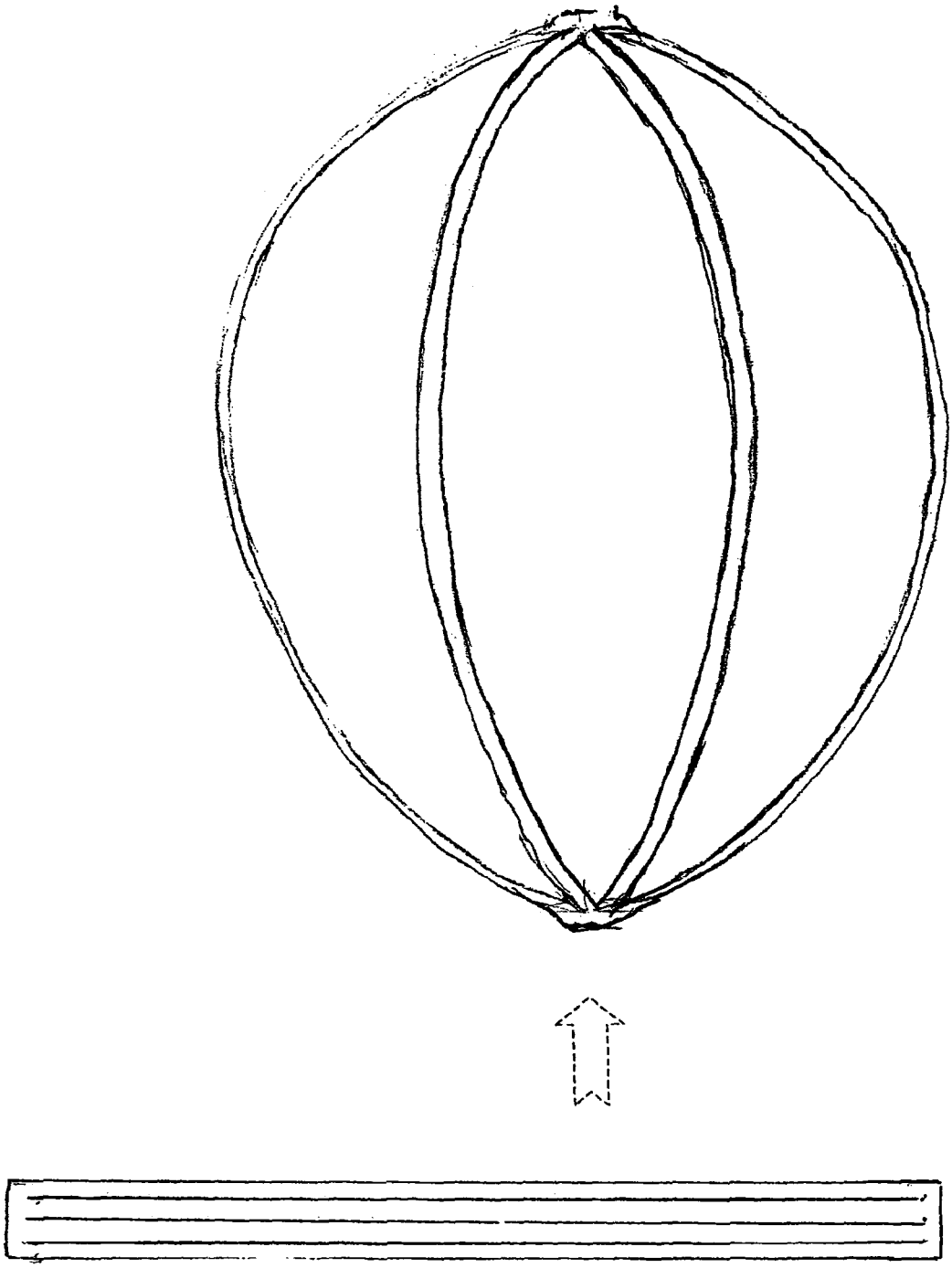
Figure 7:
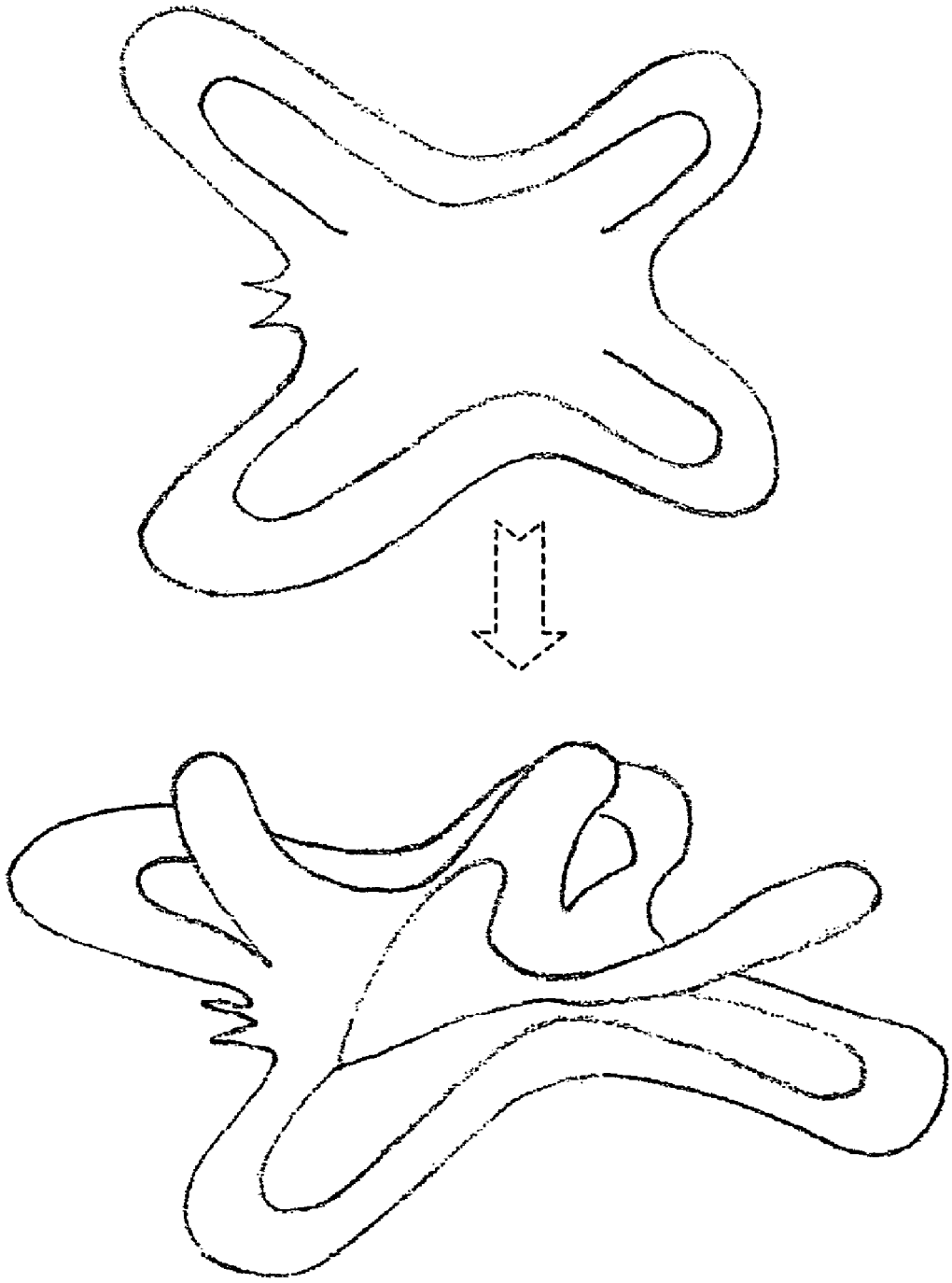
Figure 8:
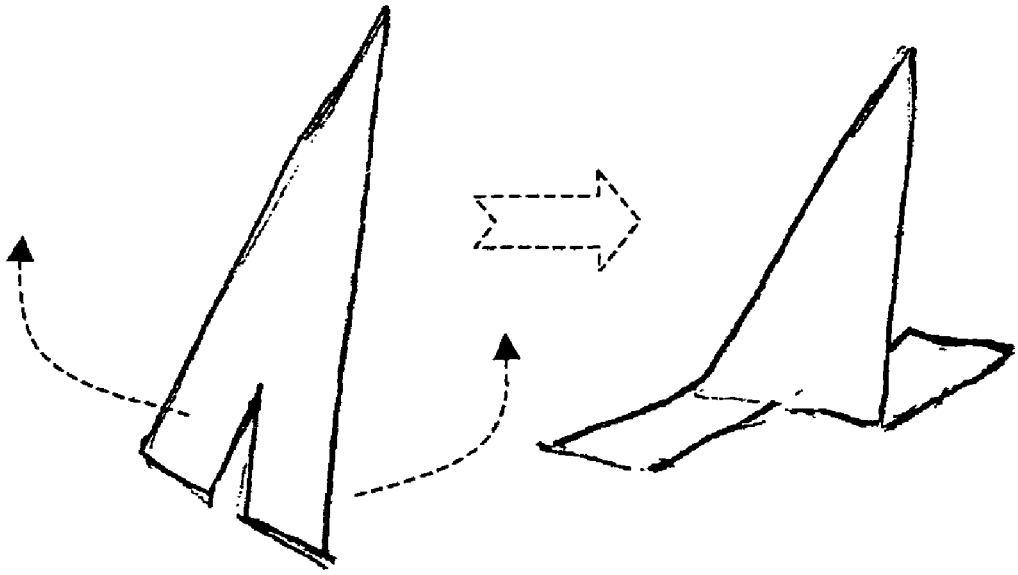
Figure 9:
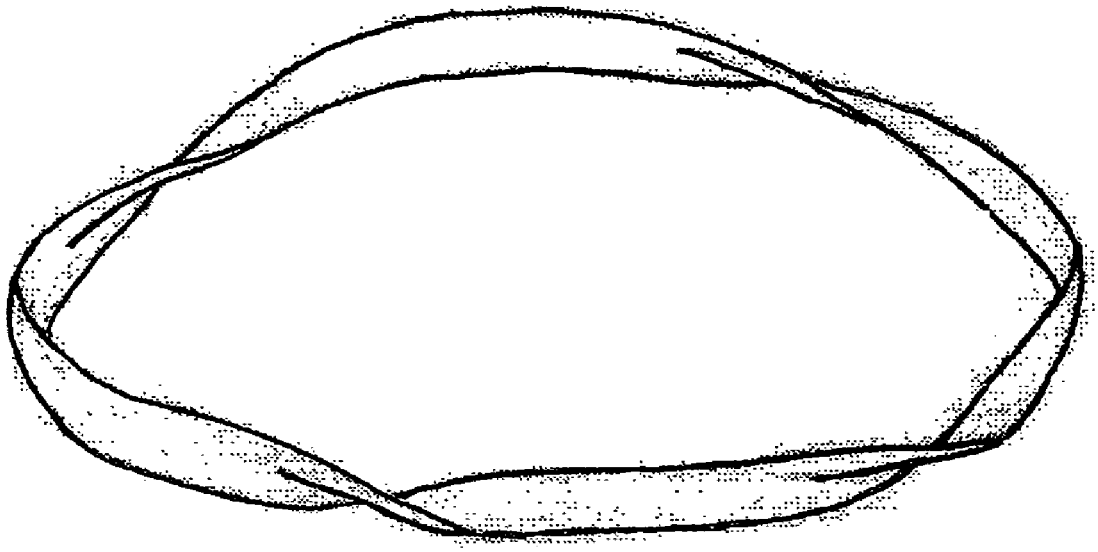
Figure 10:
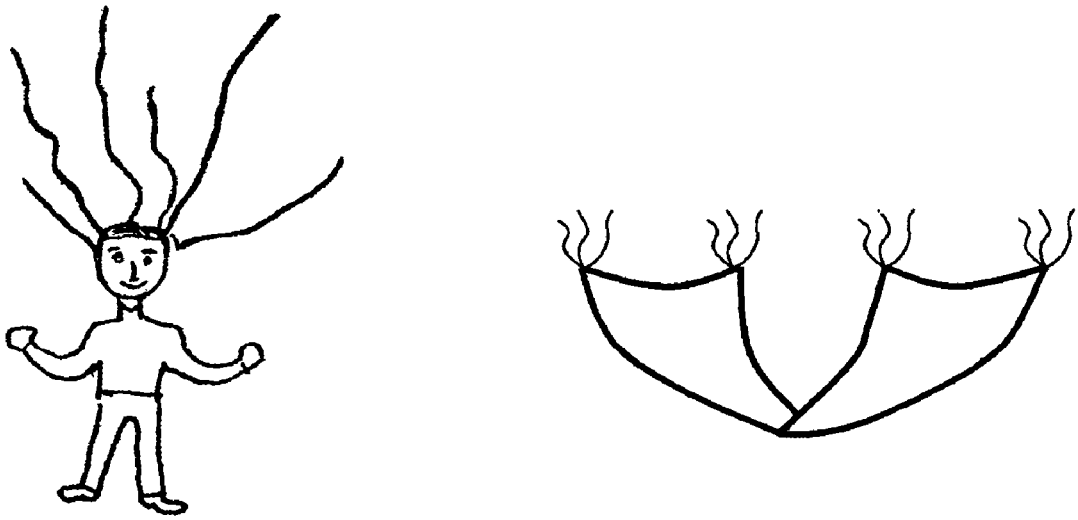

FIG. 4 shows a levitating object formed as a parabolloid. FIG. 5 shows a levitating object formed by cutting through a flat strip of a film, which then forms a ring during charging. FIG. 6 shows a levitating object obtained by several throughcuts in a flat film strip, which forms a sphere during charging. FIG. 7 shows the levitating object formed by throughcuts in a flat figure of a butterfly, which then forms a three dimensional butterfly after charging. FIG. 8 shows the levitating object with aerodynamic properties in form of a flat model of a rocket. FIG. 9 shows a levitating object with aerodynamic properties in form of a twisted ring. FIG. 10 shows the levitating objects with synthetic or natural fibers attached to them, that provide stabilization of their position during levitation.

Figure 11:
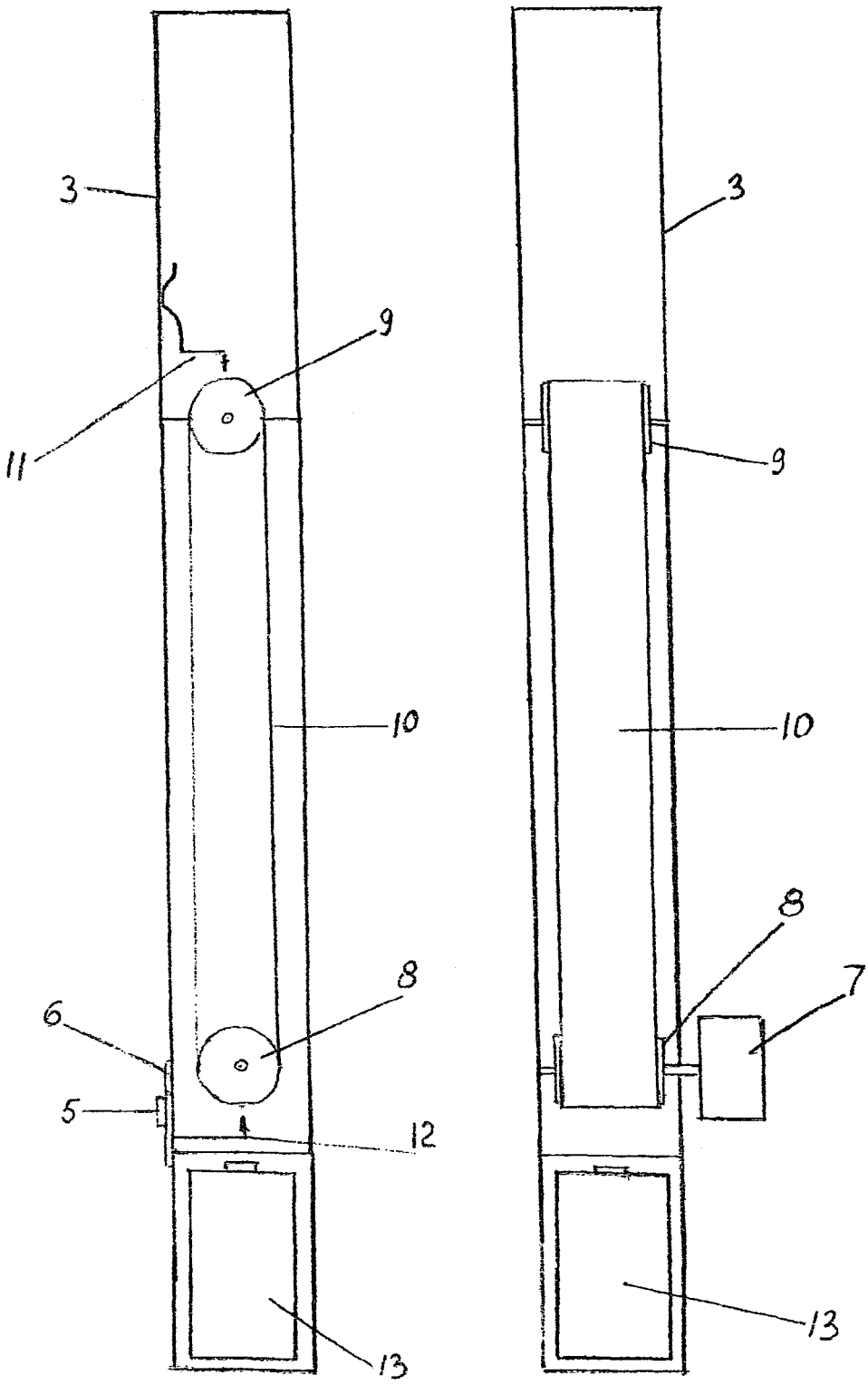
FIGS. 11-16 are views showing various embodiments of a wand with an automatic recharging of the electrostatic toy in accordance with the present invention.
Figure 12:
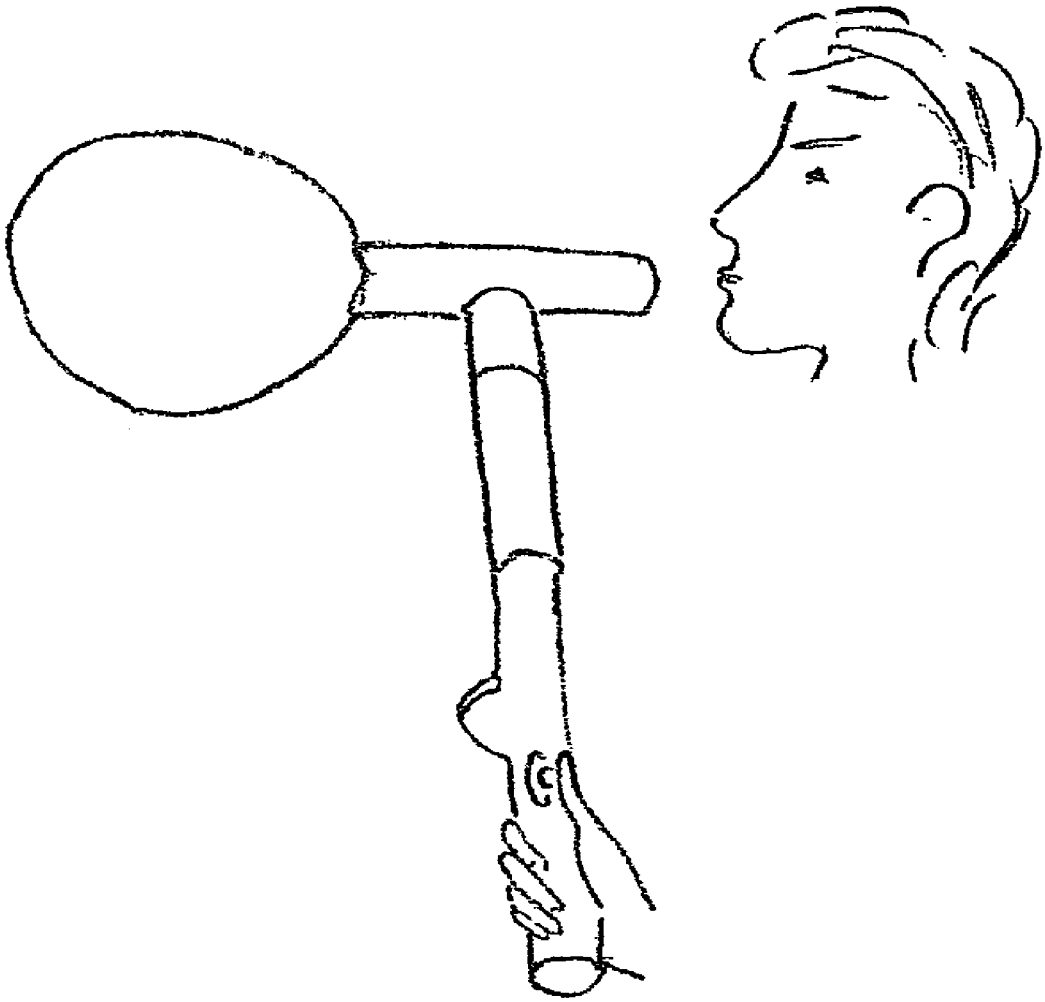
Figure 13:
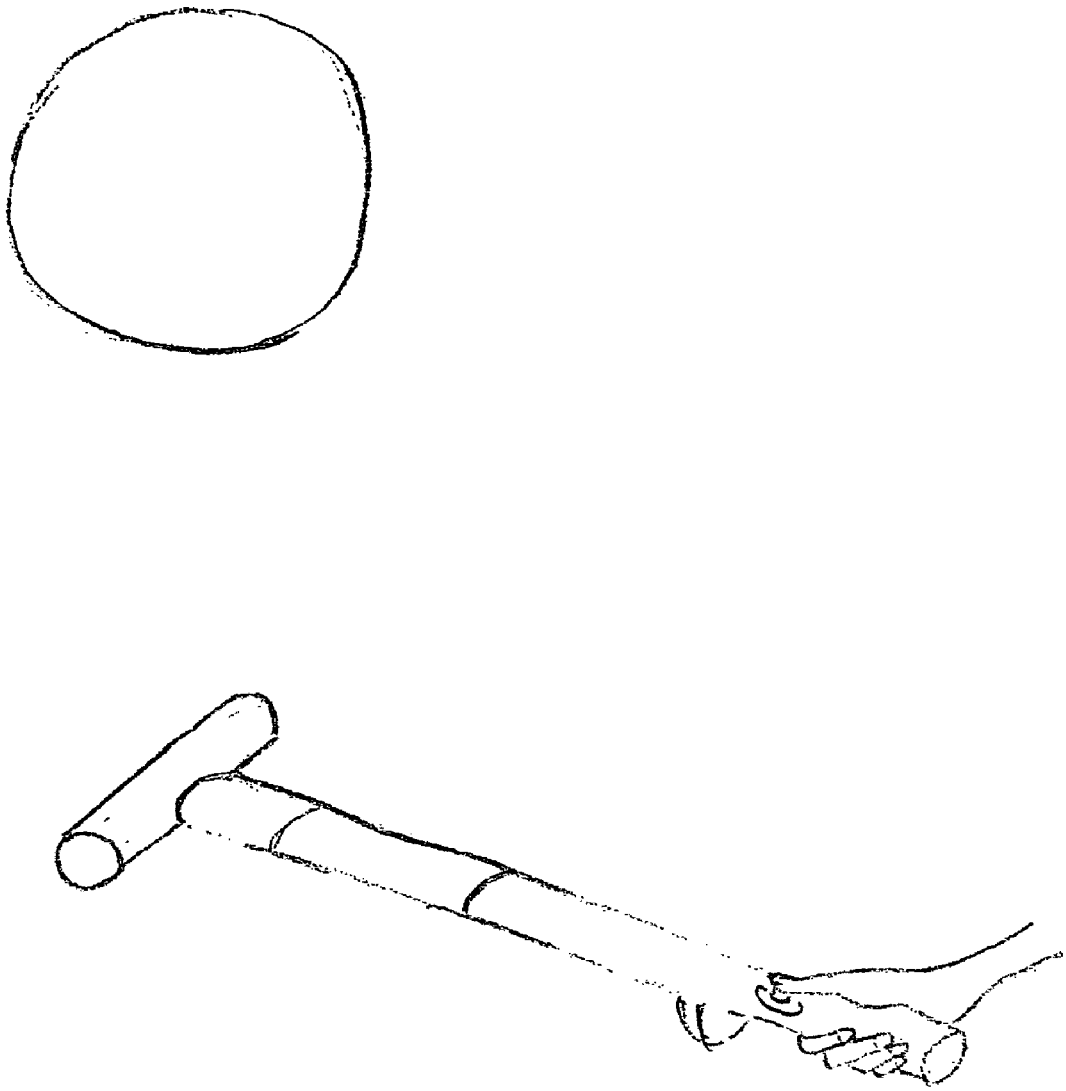
Figure 14:
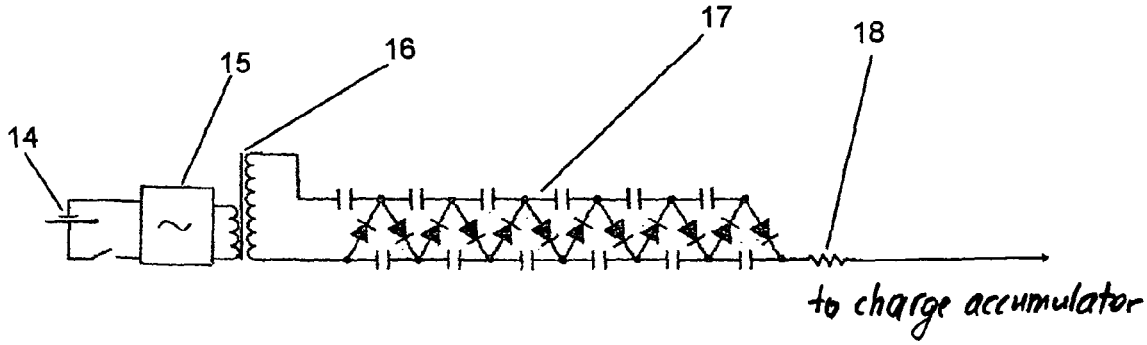

FIG. 11 shows a wand which is based on a Van der Graaf generator. FIGS. 12 and 13 show the wand with a nozzle for blowing of soap bubbles. FIG. 14 shows the wand with a generator of electric charge in form of a piezo-crystallic converter of a mechanical energy into electrical energy.

Figure 15:
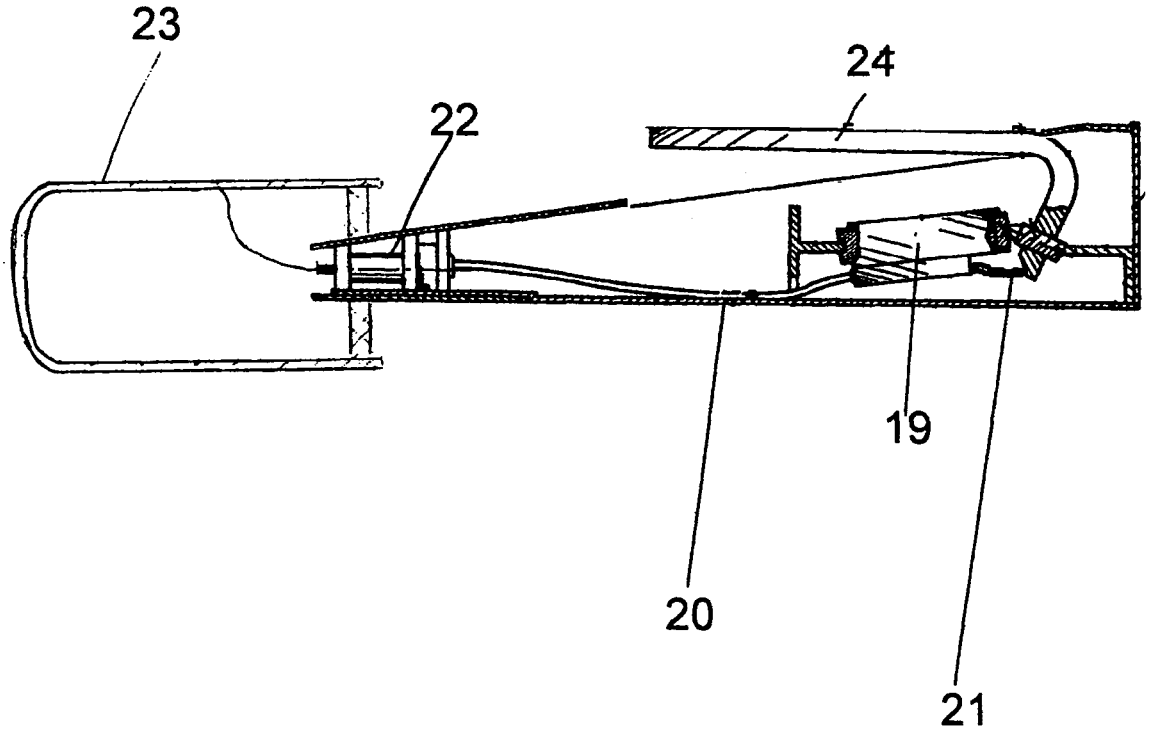
Figure 16:
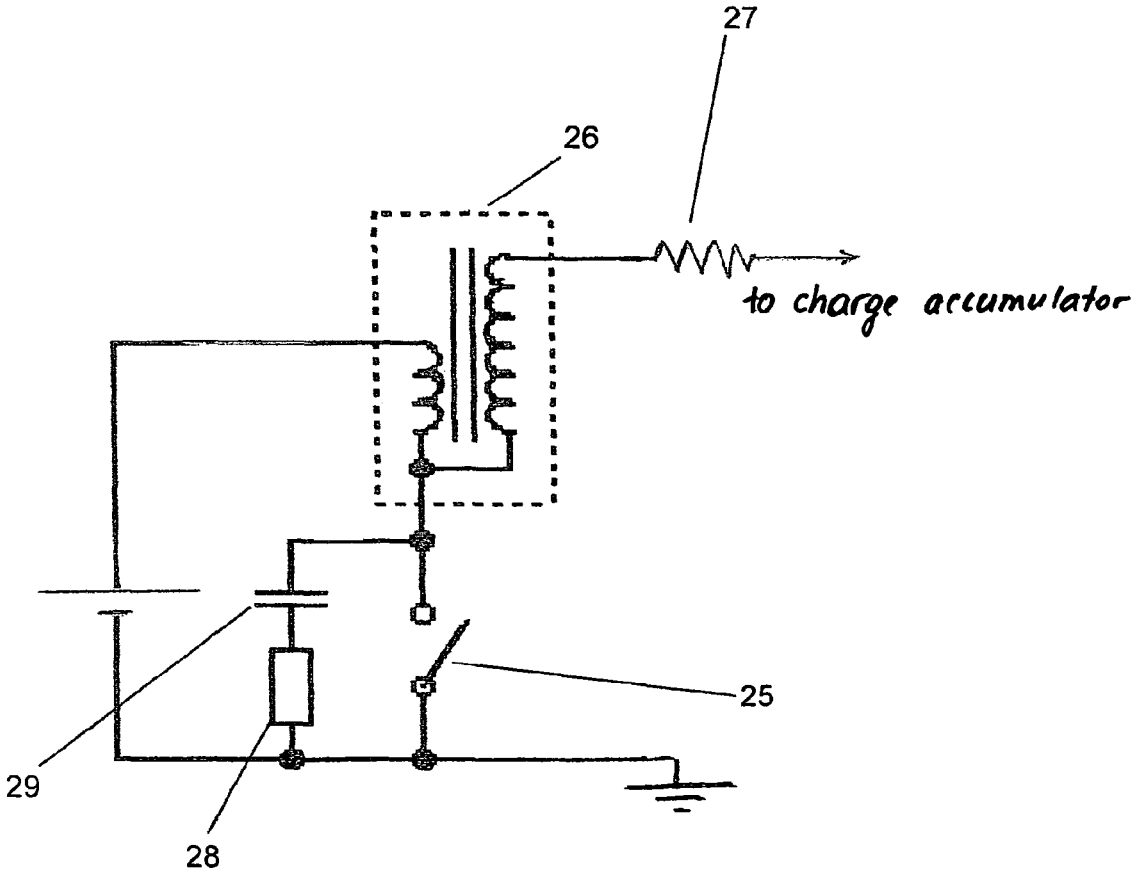

FIG. 15 shows a basic circuit of a generator of electrostatic voltage with a voltage summation unit. FIG. 16 shows a basic circuit of a generator of electrostatic charge with a breaker and a primary circuit of a high voltage transformer.

The electrostatic object can be composed of a dielectric material, such as for example a polymeric film, cigarette paper or combination of these materials. In order to increase electrical conductivity and correspondingly electrical capacity of the levitating object, a thin metallized coating can be applied on the dielectric material, or the material can contain a powder or fibers composed of electrically conductive material, such as metal or graphite. The metallized coating of the dielectric material can be formed by applying of a micron layer of metal over the whole surface of the levitating objects or on its separate parts in form of strips or shaped patterns.

The levitating objects can be composed of metallized polymeric bands which are glued with one another. As explained herein above, the shape of the levitating object 1 can be a ring as shown in FIG. 1, a sphere as shown in FIG. 2, a torus as shown in FIG. 3, a parabolloid as shown in FIG. 4, etc.

The levitating objects can be also made by throughcuts of a flat sheet of the metallized film or paper. As a result the levitating object obtains a predetermined three dimensional shape after being electrically charged from the wand. The ring shown in FIG. 5, the sphere shown in FIG. 6, the butterfly shown in FIG. 7 and other figures can be obtained from the flat sheet.

For providing a desired vertical position in space, some levitating objects can be additionally provided with a vertical position stabilizer. The vertical position stabilizer of the levitating object can be formed as one or several bundles of synthetic or natural fibers, arranged in the upper part of the levitating object as shown in FIG. 10.

In order to provide a possibility of rotating of a rocket model shown in FIG. 8 in air, the rocket model can be formed as an elongated unilateral triangle with a throughout near its base, and with opposite petals bent toward the sides. By displacement of the wand, the rocket can be moved in space. An oncoming air stream which flows onto the bent petals provides the rotation of the rocket.

For obtaining rotation of a ring during its flight, it can be composed of a preliminarily twisted metallized polymeric band shown in FIG. 9. During movement of the ring in space, an additional aerodynamic effect is provided due to the oncoming air stream.

The electrostatic generator of the electricstatic toy in accordance with the present invention can be formed as a Van de Graaf generator shown in FIG. 11. It can include an electric motor 7, two pulleys 8 and 9 which are connected with one another by a belt 10. One of the pulleys 8 can be composed of a dielectric material and arranged on the shaft of the electric motor 7, while the other pulley 9 can be composed of metal. Two brushes 11 and 12 are provided for taking off the electric charge and they can be formed as needles facing perpendicularly toward the exterior surface of the belt 10. One of the brushes 12 can be connected with the metal gasket 6 on the casing of the generator and arranged near the dielectric pulley 8, while the other brush 11 can be connected with an interior surface of the accumulator of charges 3 and arranged near the metallic pulley 9.

The electrostatic toy in accordance with the present invention operates in the following manner.

In response to pressing of the button 5, voltage of the battery 13 is supplied to the electric motor 7, and as a result the pulley 8 and correspondingly the belt 10 are moved. When the button 5 is pressed, simultaneously a contact of a hand of a playing person with the electrically conductive gasket 6 connected to the brush 12 takes place, which provides the effect of its grounding. Since the belt 10 is composed of rubber and the lower pulley 8 is composed of silicon, during the contact the belt 10 is charged positively while the pulley 8 is charged negatively. It is important that the concentration of charge on the pulley 8 is significantly higher than on the belt 10, and thereby near the pulley 8 at the lower brush 12 a field of the negatively charged lower pulley is dominating. The voltage of this field, is especially high near the tip of the brush. Movable negatively charged electrons leave the tip due to the electrostatic repelling of the identically charged pulley. As a result, the brush 12 is charged positively. In addition, ionization of air takes place near its tip.

Molecules of air loose electrons and are charged positively. The electrons are attracted to the positive brush 12, and positive ions are attracted to the negatively charged pulley 8. Since on their way there is the belt 10, they are deposited on its outer surface and moved toward the upper pulley 9. Near the upper pulley 9 the positive charges on the belt attract the movable electrons in the brush 11. An electrostatic field is generated, which causes ionization of air, and as a result the positive ions of air are attracted to the brush 11, while electrons are attracted to the belt 10. The positive charge obtained by the brush 11 is immediately transferred to the exterior surface of the hollow electrode 3.

Since the positive charge is continuously supplied to the hollow electrode 3 and is accumulated on it, the electrode can accumulate theoretically and limitlessly high charge. However, with a growth of the charge, also its leakage from the electrode takes place, and eventually equilibrium is achieved, with which the charge on the electrode no longer grows. When the electrode-accumulator 3 is charged, it is brought in contact with one of the levitating objects, and as a result the levitating object obtains the same charge and is repelled from the wand. By moving the wand 2 under the object 1 which is hovering in air (FIG. 1), a controlled displacement of the levitating object in air is achieved. During movement of the levitating objects with special aerodynamic properties (FIGS. 9 and 10) their rotation is obtained as well due to the oncoming flow of air.

When other materials are selected for the belt and the pulleys, instead of positive electric charge, a negative electric charge can be provided on the electrode-accumulator, which however does not influence the operation of the toy.

Soap bubbles can also be formed as the levitating electrically charged objects. The wand shown in FIGS. 12 and 13 allows to blow automatically electrically charged bubbles, and then to control them by means of the wand. For blowing the levitating soap bubbles, a plastic nozzle with a pipe for blowing soap bubbles is placed on the electric wand so that it is located perpendicular to the axis of the wand. The wand is inclined so that one end of the pipe is dipped into a soap solution and it is raised. On this end a soap film is formed. Then, exhaling air is blown into the opposite end of the pipe with simultaneous turning on of the electrostatic generator (FIG. 12). The thusly formed soap bubble is charged from the charge of the generator which is located near the accumulator. Therefore during the separation of the bubble it is repelled from the identically charged wand. By manipulating the wand, a stabile hovering and flight of the bubble along different trajectories is achieved (FIG. 13).

In order to charge the wand to the level which is necessary for operation of the toy, it is necessary to supply high voltage within the range of approximately 10-20 kV to the charge accumulator. For obtaining the required charge on the accumulator it suffices to provide a short-term high voltage pulse. There are many ways of obtaining such pulses. Therefore, within the spirit of the present invention, the electrostatic generator in the wand 2 can be based on several principles, in particular as a connected-in-series source of alternating voltage, increasing transformer, and voltage summater; as a piezo-electric converter; as a breaker (interrupter) of direct current in a circuit of a primary winding of an increasing transformer.

In the first embodiment with the voltage summater (FIG. 14), an electrical battery 14 supplies voltage to a generator of alternating voltage 15, whose input is connected to a primary winding of the increasing transformer 16. The increased alternating voltage is supplied from the secondary winding of the transformer 16 to the voltage summater 17. At the output of the voltage summater 17 a voltage of substantially 20 kV is generated, which, through a current limiter 18, is supplied to the electrode-accumulator of charge.

In the second embodiment with the piezo-electric converter (FIG. 15), in response to the mechanical compression of the piezo-electric crystal 19 by a level mechanism, a high voltage of 10-15 kV is formed on its sides, which is taken from electrical terminals 20 and 21. Through the terminal 20 and current limiter 22, high voltage is supplied from one side of the crystal to an interior surface of an electrode-accumulator 23, while a second side of the crystal through the terminal 21 and a handle of a lever mechanism 24 is grounded on a body of a person which presses the lever.

In the last embodiment, with the direct current breaker, in the circuit of the primary winding of the increasing transformer (FIG. 16) the charge is generated in the following manner. When the terminals of an off switch 25 are closed, direct current flows through the primary winding of the transformer 26 and creates an electromagnetic field inside a steel core. This current is limited by an inner resistance of the primary winding, which is small and constitutes only a few ohms. When the terminals of the off switch 25 are opened, current in the primary winding is interrupted, the magnetic field disappears and releases energy in form of high-volt pulse of voltage of self-induction, which constitutes several hundreds of volts. This voltage is multiplied on the second winding of the increasing transformer 26. As a result, in the second winding a voltage pulse of substantially 20 kV is formed, which through the torque limiter 27 is supplied to the electrode-accumulator of charge. The circuit composed of a resistor 28 and a capacitor 29 serves for limiting the current in a circuit of the primary winding, and also for limiting the current through the off switch 25 during its repeated closing when the capacitor 29 is discharged through it.

It will be understood that each of the elements described above, or two or more together, may also find a useful application in other types of constructions differing from the type described above.

While the invention has been illustrated and described as embodied in an electrostatic toy, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

The invention claimed is:

1. An electrostatic levitation toy, comprising a levitating object; an electrostatic wand which causes levitation of the object; said wand being provided with a power-operated electrostatic generator charging said wand and said levitating object to repel said object from said wand, means for turning on said power-operated electrostatic generator and charging and recharging said wand and said levitating object with one hand of a user when the user hold said want in said one hand, wherein said electrostatic generator is a Van der Graaf generator and includes an electric motor, a battery, two pulleys composed of different materials, connected with one another by a belt and including one pulley arranged on a shaft of said electric motor and another pulley, two brushes for taking an electric charge facing perpendicular to an exterior surface of said belt and including one brush located near said one pulley and grounded to a body of the user and another brush located near said another pulley and connected with an accumulator of electric charge.

2. An electrostatic levitation toy as defined in claim 1, wherein said electrostatic generator includes an accumulator of electric charge.

3. An electrostatic levitation toy as defined in claim 2, wherein said accumulator of electric charge is composed of an electrically conductive material with a low specific electrical conductivity.

4. An electrostatic levitation toy as defined in claim 3, wherein said accumulator of electric charge is composed of the electrically conductive material selected from the group consisting of a cardboard, a paper, and an electrically conductive plastic.

5. An electrostatic levitation toy as defined in claim 2; and further comprising a nozzle for blowing a soap bubble forming levitating object and charged identically with said accumulator of electric charge for levitating of the soap bubble after separation from said nozzle.

6. An electrostatic levitation toy as defined in claim 1, wherein said levitating object is composed of a plastic film which is at least partially metalized.

7. An electrostatic levitation toy as defined in claim 1; and further comprising means for blowing a charged soap bubble forming the levitating object.

8. An electrostatic levitation toy as defined in claim 1, wherein said levitating object is configured as an object selected from the group consisting of a flat object and a three-dimensional object.

9. An electrostatic levitation toy as defined in claim 1, wherein said levitating object is configured so that it is initially flat and thereafter becomes three-dimensional after charging.

* * * * *